US007946242B2

(12) United States Patent
Aubrey

(10) Patent No.: US 7,946,242 B2
(45) **Date of Patent: *May 24, 2011**

(54) KAYAK HULL/DECK FLARES

(76) Inventor: William Alfred Aubrey, Oshkosh, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/799,291

(22) Filed: Apr. 20, 2010

(65) Prior Publication Data

US 2010/0229779 A1 Sep. 16, 2010

Related U.S. Application Data

(63) Continuation-in-part of application No. 12/228,167, filed on Aug. 11, 2008, now Pat. No. 7,739,976.

(51) Int. Cl.

| | |
|---|---|
| ***B63B 35/71*** | (2006.01) |
| ***B63B 39/00*** | (2006.01) |
| ***B63B 39/06*** | (2006.01) |
| ***B63B 43/04*** | (2006.01) |

(52) U.S. Cl. ..... 114/347; 114/126

(58) Field of Classification Search ..... 114/121, 114/123, 126, 343, 347–350, 357, 364; D12/300, D12/302, 307, 310–314, 317; D21/769, D21/770, 801, 803; 440/101–110
See application file for complete search history.

(56) References Cited

U.S. PATENT DOCUMENTS

| | | | | |
|---|---|---|---|---|
| 289,208 | A * | 11/1883 | Besosa | 114/126 |
| 1,100,467 | A * | 6/1914 | Balazs | 114/348 |
| 3,599,257 | A * | 8/1971 | Erickson | 114/347 |
| 7,739,976 | B2 * | 6/2010 | Aubrey | 114/347 |

FOREIGN PATENT DOCUMENTS

JP 2007008178 A * 1/2007

* cited by examiner

*Primary Examiner* — Ajay Vasudeva

(57) ABSTRACT

The addition of flares to a kayak hull at or above the hulls shear/water line will increase the kayak's stability in rough water conditions by providing secondary stability by increasing the effective hull cross section of the kayak when waves interact with the flares. The location of the flares above the shear/water line will also keep the hull cross section to a minimum for easier paddling in calm water conditions.

2 Claims, 5 Drawing Sheets

KAYAK HULL/DECK FLARES

RELATED APPLICATIONS

This patent application is a continuation-in-part of U.S. application Ser. No. 12/228,167 filed on Aug. 11, 2008, now U.S. Pat. No. 7,739,976.

BACKGROUND OF THE INVENTION

This invention is in the field of kayak hull design. Basically, kayak hulls come in multiple designs and widths. Narrow hulls are fast, yet less stable in rough water conditions. Wide hulls are stable under most water conditions, but are slow and require more effort to paddle over long distances.

BRIEF SUMMARY OF THE INVENTION

This invention incorporates a narrow hull profile below the shear/water line with flares to widen the hull above the shear/water line to provide additional stability in rough water conditions. Waves in rough water conditions will wrap around the lower hull and make contact with the flares, increasing the amount of hull in contact with the water and therefore increasing the hull's stability.

DRAWINGS

Reference Numerals

100—kayak hull
101—flares
102—shear line
103—water line
104—Maximum width of the flare in the forward region of the hull
105—Maximum width of the flare in the aft region of the hull
106—kayak bow
107—kayak stern
108—Cockpit

DETAILED DESCRIPTION OF THE INVENTION

Figure 2:
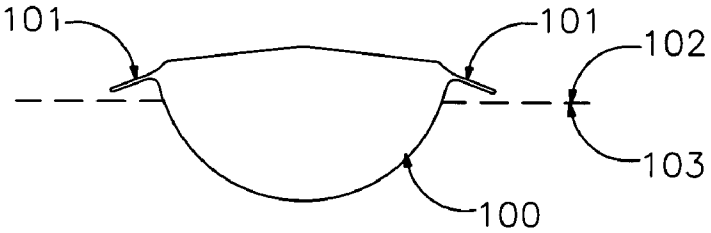

This invention is an improvement on kayak hull designs by adding hull/deck flares 101 above the shear 102/water 103 line to increase stability in rough water conditions without increasing the hull's cross section in calm water conditions (see FIG. 2). The hull/deck flares 101 do not contact the water until rough water conditions producing waves that raise the water into contact with the flares 101 (see FIG. 3). The increased amount of hull in contact with the water increases the kayak's stability.

Figure 1:
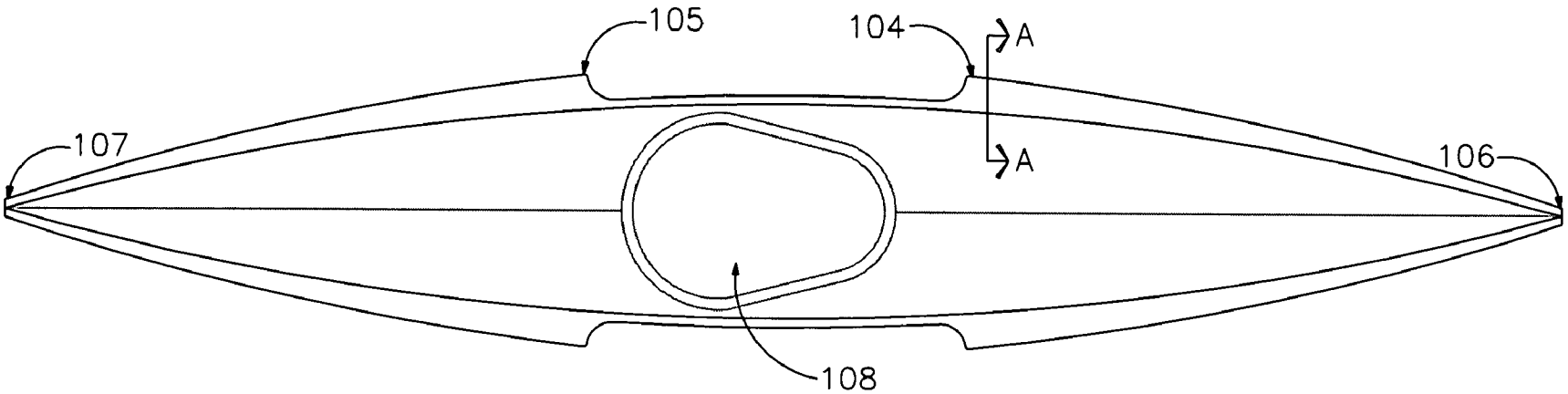
FIG. 1—Shows the hull in plan view. This shows the area near the cockpit left open for clear paddling FIG. 2—Shows the hull in cross section. This view shows the flares' position in relation to the shear/water line in calm conditions.
Figure 3:
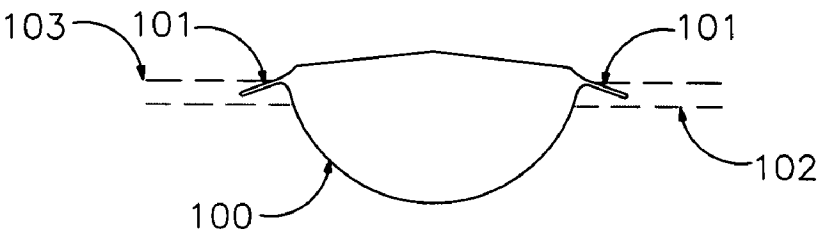
FIG. 3—Shows the hull in cross section. This view shows the flares position in relation to the water line in wavy conditions.

FIG. 1 shows the kayak having a cockpit 108 with an opening located substantially centrally between a bow 106 and a stern 107 of the kayak hull 100. The flares 101 extend between the bow 106 and the stern 107 substantially outboard from the sidewalls of the kayak hull 100. As seen in FIG. 2 and FIG. 3, the flares 101 are located near the upper edges of the hull sidewalls and extend substantially horizontally above the water line 103 in calm water conditions. FIG. 1 further shows the flares increasing in width from the bow 106 toward the cockpit 108 to a maximum forward with 104, and from the stern 107 toward the cockpit 108 to a maximum rear width 105, in a region proximal the cockpit opening. Each of the maximum forward width 104 and the maximum rear width 105 of the flares 101 is approximately four inches beyond the sidewalls of the hull 100. The flares 101 taper to a range between approximately zero to two inches at the bow 106 and the stern 107. In the region adjacent the cockpit opening, the flares 101 have a substantially reduced width of approximately ¼ relative to the maximum forward width 104 and the maximum rear width 105 to define the recess in the respective outboard edge of each flare 101. The recess in each flare 101 extends from approximately just rearward of the cockpit 108 to approximately just forward of the cockpit 108, and allows unobstructed paddling by a user of the kayak. The flares increase the stability of the kayak in rough water without increasing the drag on the hull.

Figure 4:
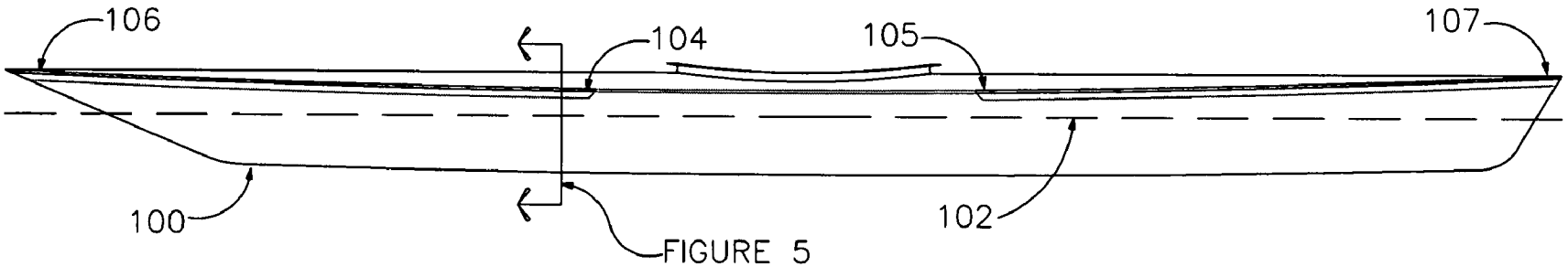
FIG. 4—Shows the hull in elevation (side) view. This view shows the rise of the flares at the bow and stern which prevent the wings from increasing the boat's tendency to dive into waves.
Figure 5:
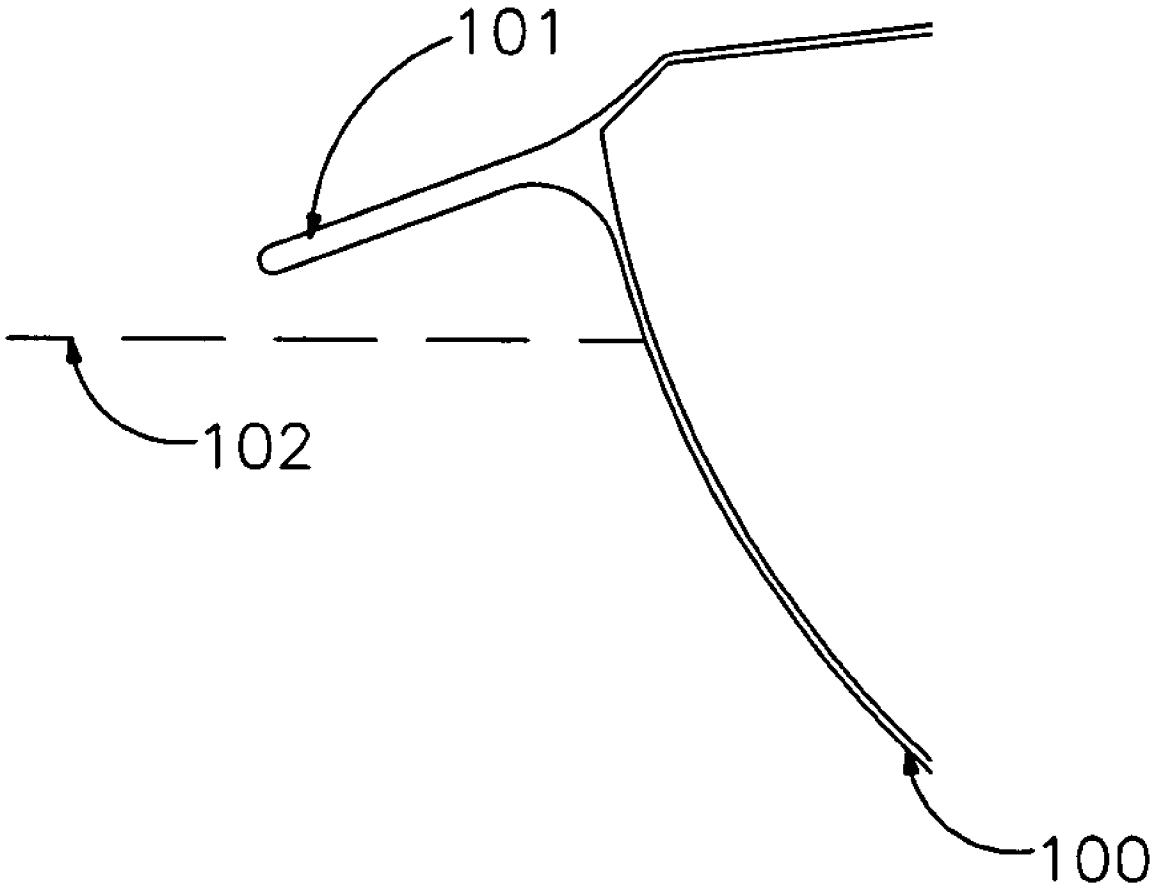
FIG. 5—Shows a close up view of the flares at section A-A in FIG. 1.

The flares should rise upward as they get closer to the bow 106 and stern 107 (see FIG. 4A). This allows waves to flow under the flares providing lift in lieu of pressing downward onto the flare. This improves the performance of the flares by increasing the amount of water underneath the hull and by keeping the hull's bow 106 and stern 107 above the waves. If the flares enter a wave, the design will still improve stability by providing a greater hull cross-section.

Waves intersecting the hull from a ninety degree angle will have no effect on the hull's stability because the amount of hull in contact with the water has been increased.

Figure 6:
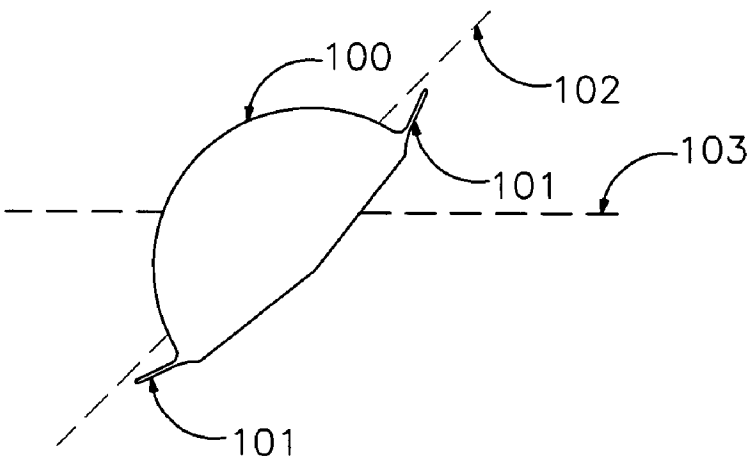
FIG. 6—Shows the hull cross section in an overturned and mid-roll positions.
Figure 6:
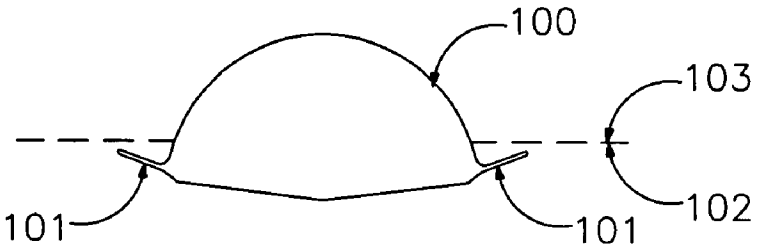

FIG. 6—shows a substantially downward angle on the sidewall flares that will increase the ability of a person to right the kayak if it becomes capsized. This is due to the reduced resistance a downward angled flare will impart on the water when the kayak is in this position and when the kayaker attempts to right the kayak.

The invention claimed is:

1. A kayak comprising:

a hull having port and starboard sidewalls and a cockpit with an opening located substantially centrally between a bow and a stern of the hull;

port and starboard flares extending between the bow and stern substantially outboard from the sidewalls, said flares located proximal upper edges of the sidewalls and extending outwardly from the sidewalls at an angle, said angle having a range between about zero degree and negative forty five degrees with respect to a horizontal plane above the water line in calm water conditions, each flare increasing in width from the bow and the stern toward the cockpit to a maximum width in a region proximal the cockpit opening, each flare further having substantially reduced width relative to the maximum width to define a recess in an outboard edge of the flare adjacent the cockpit opening;

wherein the flares are configured to increase the stability of the kayak in rough water without increasing drag on the hull; and wherein each said recess is configured to allow unobstructed paddling.

2. The kayak according to claim 1, wherein the downwardly angled flares allow the kayak to be more easily righted when the kayak becomes capsized.

* * * * *